US005134257A

United States Patent [19]

Oka et al.

[11] Patent Number: 5,134,257

[45] Date of Patent: Jul. 28, 1992

[54] ROTOR ELECTRODE FOR A DISTRIBUTOR

[75] Inventors: Kazuhiro Oka; Takeshi Morita; Seigo Hiramoto, all of Amagasaki; Yutaka Ohhashi, Himeji, all of Japan

[73] Assignee: Mitsubishi Denki Kabushiki Kaisha, Tokyo, Japan

[21] Appl. No.: 683,916

[22] Filed: Apr. 11, 1991

[30] Foreign Application Priority Data

Apr. 13, 1990 [JP] Japan ..... 2-98789
Jun. 26, 1990 [JP] Japan ..... 2-170914

[51] Int. Cl.[5] ..... H01H 19/00; F02P 7/02
[52] U.S. Cl. ..... 200/19 DR; 200/19 R
[58] Field of Search ..... 200/19 R, 19 DR, 19 DC

[56] References Cited

U.S. PATENT DOCUMENTS

| | | | |
|---|---|---|---|
| 4,007,342 | 2/1977 | Makino et al. | 200/19 R |
| 4,177,366 | 12/1979 | Kozuka et al. | 200/19 DR |
| 4,217,470 | 8/1980 | Kirner | 200/19 R |
| 4,369,343 | 1/1983 | Sone et al. | 200/19 DR X |
| 5,006,674 | 4/1991 | Ohashi | 200/19 R |
| 5,045,653 | 9/1991 | Ohashi | 200/19 DR |

FOREIGN PATENT DOCUMENTS 61-38351 8/1986 Japan .

*Primary Examiner*—J. R. Scott

*Attorney, Agent, or Firm*—Sughrue, Mion, Zinn, Macpeak and Seas

[57] ABSTRACT

A distributor rotor electrode comprising an electrode head having a pair of flat surfaces substantially parallel to a plane of rotation of the rotor electrode and a generally arcuated, convexed discharge surface perpendicular to the plane of rotation to define a discharge gap on it. The electrode head has an electrically high-resistance layer attached to at least the pair of substantially flat surfaces, and comprises a material including a ceramic effective to suppress noise electromagnetic wave radiation at the discharge surface. The high-resistance layer material may comprise 10% to 70% of SiC and a mixture of SiOx, Si and C and may be attached to the discharge surface as well as to the flat surfaces, or to the flat surfaces only to expose the arcuated discharge surface to the discharge gap. The arcuated discharge surface may have ridges and grooves extending generally perpendicularly to the plane of rotation, and may have a wave-shaped or comb-shaped contour. The high-resistance layer may have a first ceramic layer of a first ceramic material exhibiting a good noise suppressing characteristic at the discharge surface and a second ceramic layer of a second ceramic material exhibiting a good adhesive characteristic at where it is attached to electrode head. The first ceramic material may comprise nitride ceramic or carbide ceramic such as silicon carbide and the second ceramic material may comprise oxide ceramic such as aluminum oxide.

23 Claims, 5 Drawing Sheets

ROTOR ELECTRODE FOR A DISTRIBUTOR

BACKGROUND OF THE INVENTION

This invention relates to a rotor electrode for a distributor for use in an internal combustion engine and, more particularly, to a distributor rotor electrode on which a high-resistive layer for suppressing noise is provided on an electrode surface.

FIGS. 17 to 19 illustrate one example of a conventional distributor 1 disclosed in U.S. Pat. No. 4,007,342 to which a distributor rotor electrode 2 of the present invention may be installed. The distributor 1 comprises a rotary shaft 3 to which the rotor electrode 2 is connected for rotation therewith and a plurality of stationary electrodes 4 disposed around the rotary shaft 3.

The rotor electrode 2 comprises an electrode arm 5 securely connected at one or inner end to the rotary shaft 3 of the distributor 1 for rotation therewith in a plane perpendicular to the rotary shaft 3. The rotor electrode 2 also comprises an electrode head 6 integrally connected to the other or outer end of the electrode arm 5. The electrode head 6 comprises a pair of substantially flat surfaces 7 substantially parallel to the plane of rotation of the electrode arm 5 and a substantially arcuated, convexed discharge surface 8 substantially perpendicular to the plane of rotation of the electrode arm 5. The discharge surface 8 is adapted to face toward the stationary electrodes 4 of the distributor 1 to successively define a discharge gap 9 between the discharge surface 8 and the successive stationary electrodes 4 as the rotor electrode 2 rotates. As best seen in FIG. 19, the discharge surface 8 as well as the flat parallel surfaces 7 are coated with an electrically high-resistance layer 10 in order to suppress the noise-generating radiation. The high-resistance layer 10 is made of an oxide such as silicon dioxide, copper oxide, aluminum oxide and Invar oxide.

With this distributor rotor electrode 2, the discharge surface of the base material of the rotor electrode head 6 is completely coated with the electrically high-resistance layer 10, the electric discharge between the rotor electrode 2 and the stationary electrodes 4 cannot take place between the outer circumferential surface of the high-resistance layer 10 and the stationary electrode 4. Rather, this discharge takes place due to an insulating breakdown of a portion of the high-resistance layer 10 by a main discharge which is induced by a partial discharge generated at an interface between the discharge surface of the electrode head 6 and the inner surface of the high-resistance layer 10 at which the layer 10 is attached to the electrode head 6. Accordingly, initial main discharging is difficult to occur and unstable, so that an effective and reliable noise suppressing effect is difficult to obtain.

The high-resistance layer 10 is formed by a surface treatment process having at least one of the following surface treatment methods alone or in combination:

(1) flame spraying a high-resistance substance to the rotor electrode;

(2) flame spraying a metal exhibiting a high electric resistance when oxidized, and oxidizing the flame-sprayed metal; and (3) oxidizing a metal exhibiting a high electric resistance when oxidized, and flame spraying the oxidized metal.

According to this process, however, many defects in the form of voids appear not only in an interface between the electrode and the flame-sprayed layer, but also in the flame-sprayed layer itself, so that the bonding strength of the layer with respect to the rotor electrode is low and that slight changes in the flame-spraying conditions greatly affect the noise-suppressing effect of the flame-sprayed layer.

Another example of a conventional distributor rotor electrode disclosed in Japanese Patent Publication No. 61-38351 has at least one layer of Si varnish or an $SiO_2$ sheet including an organic binder bonded by an organic material to a thin rotor electrode. In this arrangement, a relatively thin electrode head is exposed to the discharge gap at its discharge surface in order to provide a narrow surface for an improved noise suppressing effect. With this distributor rotor electrode, however, since the organic material used to bond Si varnish or $SiO_2$ sheet to the electrode are exposed to electric arcs and the $O_3$ gas or $NO_x$ gas generated upon arcing in the discharge gap, they are relatively quickly deteriorated and the Si varnish or $SiO_2$ sheet can be relatively easily separated, thereby shortening the lifetime of the rotor electrode.

SUMMARY OF THE INVENTION

Accordingly, one object of the present invention is to provide a distributor rotor electrode free from the above discussed problems.

Another object of the present invention is to provide a distributor rotor electrode superior in the noise suppressing effect.

Another object of the present invention is to provide a distributor rotor electrode exhibiting a reliable and stable noise suppressing effect.

A further object of the present invention is to provide a distributor rotor electrode which has a high-resistance layer attached at a sufficient bonding strength.

Another object of the present invention is to provide a distributor rotor electrode which has a high-resistance layer superior in the noise-suppressing effect and yet firmly bonded to the electrode.

With the above objects in view, according to the present invention, a distributor rotor electrode for use in a distributor having a rotary shaft and a plurality of stationary electrodes disposed around the rotary shaft is provided. The distributor rotor electrode comprises an electrode arm connectable at one end to the rotary shaft of the distributor for rotation therewith and an electrode head connected to the other end of the electrode arm. The electrode head comprises a pair of substantially flat surfaces substantially parallel to a plane of rotation of the electrode arm and a substantially arcuated, convexed discharge surface substantially perpendicular to the plane of rotation of the electrode arm. The discharge surface is adapted to face toward the stationary electrodes of the distributor to define a discharge gap therebetween during its rotation. An electrically high-resistance layer attached to at least the pair of substantially flat surfaces of the electrode head, the high-resistance layer comprising a material including a ceramic effective to suppress noise electromagnetic wave radiation at the discharge surface.

The high-resistance layer material may include SiC as a main composition and may preferably comprise 10% to 70% of SiC and a mixture of SiOx, Si and C and more preferably comprise $SiC:C:Si:SiOx = 1:a:b:c$ ($0<x<2$, $0<a<4$, $0<b<4$ and $0<c<10$).

The high-resistance layer may be attached to both of the discharge surface and two flat surfaces, or the layer may be attached to two flat surfaces only so that the arcuated discharge surface of the electrode head is exposed to the discharge gap.

The arcuated discharge surface may have ridges and grooves extending generally perpendicularly to the plane of rotation, and may have a wave-shaped or comb-shaped contour.

The high-resistance layer may have a first ceramic layer of a ceramic material exhibiting a good noise suppressing characteristic at the outer surface and a second ceramic layer of a ceramic material exhibiting a good adhesive characteristic at where it is attached to the electrode head. The first ceramic material may comprise nitride ceramic or carbide ceramic such as silicon carbide and the second ceramic material may comprise oxide ceramic such as aluminum oxide and silicon oxide.

BRIEF DESCRIPTION OF THE PREFERRED EMBODIMENTS

The present invention will become more readily apparent from the following detailed description of the preferred embodiments of the present invention taken in conjunction with the accompanying drawings, in which.

DESCRIPTION OF THE PREFERRED EMBODIMENTS

Figure 17:
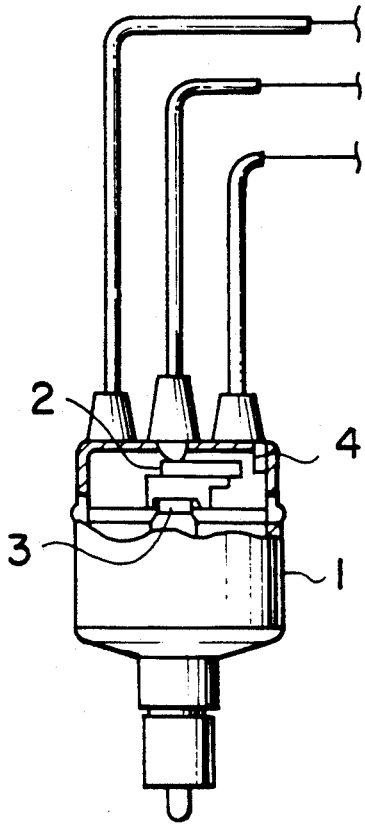
FIG. 17 is a schematic view illustrating a typical distributor to which the rotor electrode of the present invention can be used.
Figure 18:
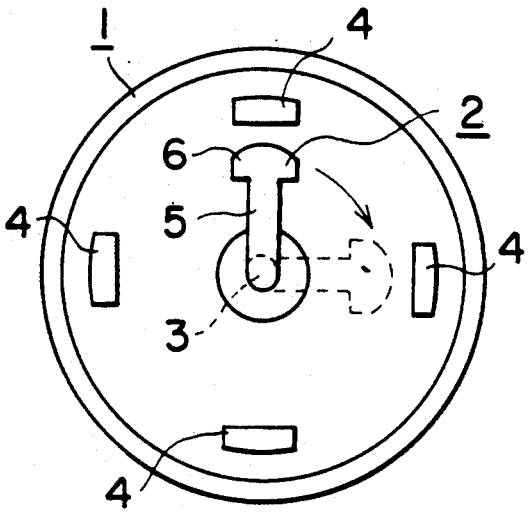
FIG. 18 is a plan view illustrating a positional relationship of the rotor electrode and the stationary electrodes illustrated in FIG. 17.
Figure 19:
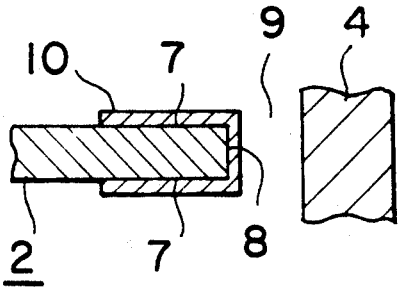
FIG. 19 is a sectional view of the rotor electrode and the stationary electrode illustrated in FIG. 18.

FIGS. 1 to 5 illustrate one embodiment of a distributor rotor electrode 12 of the present invention which may be installed in the distributor 1 in place of the rotor electrode 2 illustrated in FIGS. 17 and 18.

The rotor electrode 12 comprises an electrode arm 15 securely connectable at one or inner end thereof to the rotary shaft 3 of the distributor 1 for rotation therewith in a plane perpendicular to the rotary shaft 3. The rotor electrode 12 also comprises an electrode head 16 integrally connected to the other or outer end of the electrode arm 15. The electrode head 16 comprises a pair of substantially flat surfaces 17 substantially parallel to the plane of rotation of the electrode arm 15 and a substantially arcuated, convexed discharge surface 18 substantially perpendicular to the plane of rotation of the electrode arm 15. The discharge surface 18 is adapted to face toward the stationary electrodes 4 of the distributor 1 to successively define the discharge gap 9 between the discharge surface 18 and the successive stationary electrodes 4 as the rotor electrode 12 rotates. While the illustrated electrode head 16 is an elongated member extending transversely of the length of the electrode arm 15, many modifications of the shape of the electrode head 16 may be adopted as long as the flat surfaces 17 and the discharge surface 18 are provided. The rotor electrode 12 is made of brass or stainless steel, but may be made of any suitable electrically conductive or semi-conductive material.

According to the present invention, the rotor electrode 12 comprises an electrically high-resistance layer 20 attached at least to the substantially flat surfaces 17 of the electrode head 16. That is, the high-resistance layer 20 may be attached to the discharge surface 18 as well as the pair of substantially flat surfaces 17 but the high-resistance layer 20 may also be attached to each of the pair of substantially flat surfaces 17 only so that the arcuated discharge surface 18 of the electrode head 16 is exposed to the discharge gap 9. The exposed arcuated discharge surface 18 of the electrode head 16 has a width dimension of 3 mm or less, and preferably about 0.5 mm, as measured in the direction perpendicular to the plane of rotation. The width dimension of the exposed discharge surface 18 should be less than the width of the stationary electrodes 4 of the distributor in order to ensure that the electric discharge takes place at the discharge surface 18 of the conductive electrode head 16.

The high-resistance layer 20 is made of a material including a ceramic effective to suppress noise-generating electromagnetic wave radiation at the discharge surface 18. The high-resistance layer 20 must have a composition exhibiting balanced properties of static capacitance and dielectric loss. This is because it is necessary, on one hand, to build up a suitable amount of electric charge in order to facilitate a partial discharge at the rotor electrode which in turn causes the main discharge across the rotor electrode and the stationary electrodes, and it is also necessary, on the other hand, to release excessive amount of electric charge in order to prevent unstable discharge which is otherwise induced by the excessive charge. Such conditions can be obtained by the addition of SiOx which is dielectric as well as C and Si which are electrically conductive to SiC which is a dielectric and highly dielectric losing material. Therefore, the material of the high-resistance layer 20 includes SiC as a main composition and may comprise 10% to 70% of SiC and a mixture of SiOx, Si and C, and preferably comprises SiC:C:Si:SiOx=1:a:b:c ($0<x<2$, $0<a<4$, $0<b<4$ and $0<c<10$). Such high-resistance layer 20 may be formed by the laser vacuum evaporation method as disclosed in U.S. Pat. No. 4,816,293 in which the ceramic material such as SiC material is evaporated by a laser beam so that the evaporated material is deposited onto the electrode head 16.

When a material of a composition of $SiC_{1.5}O_{0.5}$ (Si=1) is used as the high-resistance layer 20, the rotor electrode exhibited the initial discharge voltage was from 7.2 kV to 7.9 kV and the initial discharge current was from 1.3 A to 1.8 A, which are superior initial discharge characteristics as compared to the electrode with an $SiO_x$ layer where the initial discharge voltage is from 8.0 kV to 9.3 kV and the initial discharge current is from 2.2 A to 3.2 A and to the electrode without any high-resistance layer where the initial discharge voltage is 12 kV and the initial discharge current is 5 A.

Figure 6:
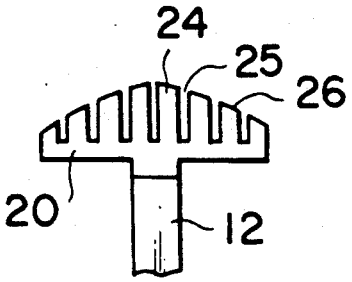
FIG. 6 is a plan view illustrating another embodiment of the rotor electrode of the present invention.
Figure 7:
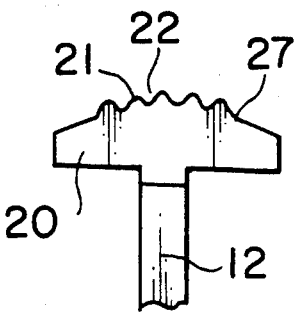
FIG. 7 is a plan view illustrating a still another embodiment of the rotor electrode of the present invention.

In the illustrated embodiment, the substantially arcuated discharge surface 18 of the electrode head 16 has a plurality of ridges 21 and grooves 22 extending substantially perpendicularly to the plane of rotation and defining a substantially wave-shaped contour 23 having one of the ridges 21 on the longitudinal center line of the rotor electrode. Alternatively, one of the grooves 22 may be positioned on the longitudinal center line of the rotor electrode 12. Other examples of the modified arrangements are illustrated in FIGS. 6 and 7, in which high ridges 24 and deep grooves 25 together define a substantially comb-shaped contour 26 illustrated in FIG. 6, and the ridges 21 and the grooves 22 are provided only in the central portion of the arcuated discharge surface 18 to define a partially wavy contour 27 illustrated in FIG. 7.

Figure 8:
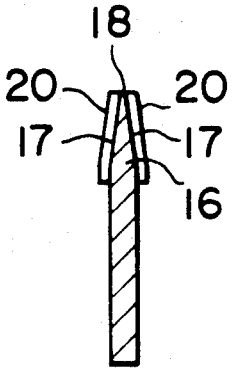
FIG. 8 is a sectional view similar to FIG. 4 but illustrating a modification of the rotor electrode of the present invention.
Figure 9:
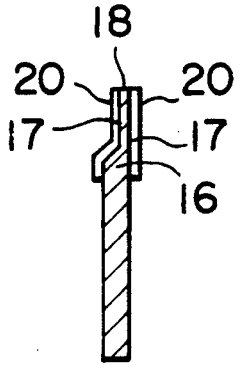
FIG. 9 is a sectional view similar to FIG. 8 but illustrating another modification of the rotor electrode of the present invention.

The substantially flat surfaces 17 of the rotor electrode 12 illustrated in FIGS. 1 to 5 are tapered or slanted relative to each other to provide a smaller thickness of the electrode head 16 at the arcuated discharge surface 18. Accordingly, the high-resistance layers 20 formed on the tapered flat surfaces 17 are also tapered or slanted relative to each other. In the embodiment shown in FIGS. 1 to 5, one of the flat surfaces 17 and therefore the high-resistance layer 20 thereon is parallel to the direction of extension of the electrode arm 15 but the other flat surface 17 and the high-resistance layer 20 thereon is slanted. FIG. 8 illustrates an electrode head in which both of the pair of flat surfaces 17 and the high-resistance layers 20 thereon are slanted, and FIG. 9 illustrates that one of the flat surfaces 17 and the high-resistance layer 20 thereon has a reduced-thickness portion defined by a transversely extending step while the other flat surface 17 and the high-resistance layer 20 are parallel to the electrode arm 15 so that the electrode head 16 has a smaller thickness at the arcuated discharge surface 18.

Figure 1:
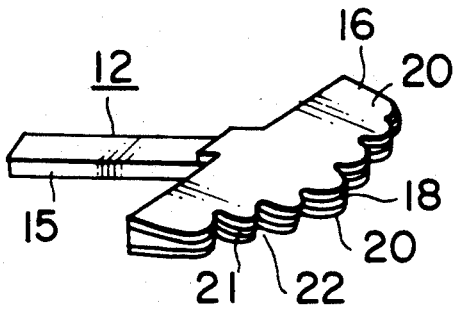
FIG. 1 is a perspective view of a distributor rotor electrode of the present invention.
Figure 2:
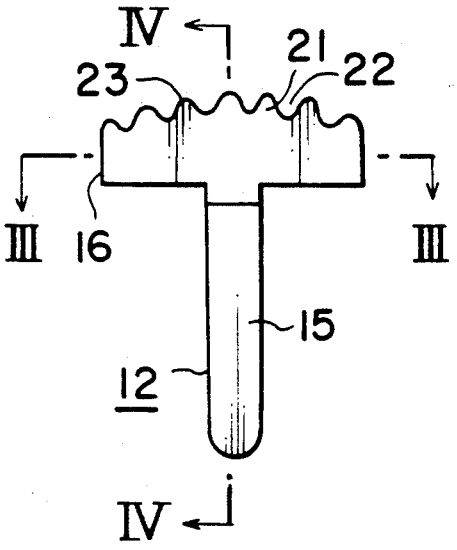
FIG. 2 is a plan view of the distributor rotor electrode illustrated in FIG. 1.
Figure 3:
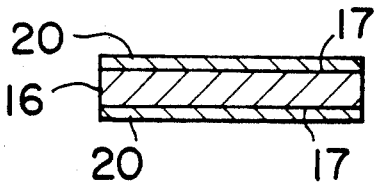
FIG. 3 is a sectional view taken along line III—III of FIG. 2.
Figure 4:
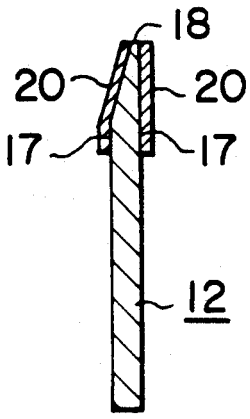
FIG. 4 is a sectional view taken along line IV—IV of FIG. 2.
Figure 5:
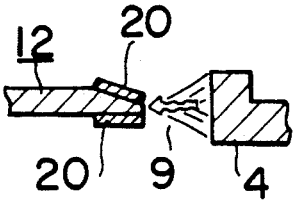
FIG. 5 is a schematic view illustrating how an electric discharge takes place between the rotor electrode and the stationary electrode.
Figure 10:
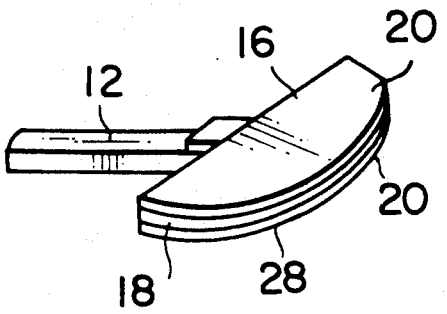
FIG. 10 is a perspective view of the distributor rotor electrode of another embodiment of the present invention.
Figure 11:
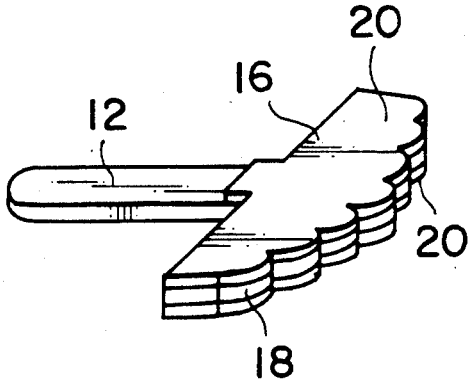
FIG. 11 is a perspective view of the distributor rotor electrode of a still another embodiment of the present invention.

FIG. 10 illustrates another distributor rotor electrode 12 comprising the tapered electrode head 16 having a smoothly curved discharge surface 18 of a smoothly curved contour 28, and FIG. 11 illustrates the electrode head 16 having the even thickness but having the wavy profile similar to that illustrated in FIG. 2.

Figure 12:
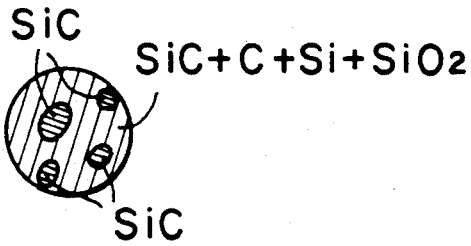
FIG. 12 is a view illustrating a system of the high-resistance layer of the rotor electrode of an embodiment of the present invention.

As an example, a rotor electrode 12 as illustrated in FIGS. 1 to 4 was manufactured. The rotor electrode 12 was made of brass of 1.2 mm thick. The rotor head has a taper angle of 15° and is 0.5 mm thick at the tip where wavy contour has nine ridges of 60°. Various high-resistance layers 20 including SiC, C and Si within a composition range of SiC:C:Si=1:x:y ($0<x<2$, $0<y<1$) were formed and tested. The test results indicated that the discharge initiating voltage of this rotor electrode with the high-resistance layer 20 was less than 6 kV whereas it was 12 kV without any high-resistance layer. This improvement was particularly significant when SiC:C:Si=1:1.6:0.6. The high-resistance layer 20 of this composition exhibited a system as illustrated in FIG. 12.

Figure 13:
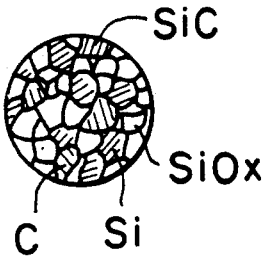
FIG. 13 is a view illustrating a system of the high-resistance layer of the rotor electrode of an embodiment of the present invention.

Another rotor electrode 12 similar to that of the previous example but have different high-resistance layers 20 of a composition range of SiC:C:Si:$SiO_2$=1:x:y:z ($0<x<2$, $0<y<1$, $0<z<2$) were manufactured and tested. The discharge initiating voltage of 12 kV without the high-resistance layer 20 was reduced to less than 6 kV with the above-mentioned high-resistance layer. This improvement was particularly significant when SiC:C:Si:$SiO_2$=1:1.6:0.6:0.4. The high-resistance layer 20 of this composition exhibited a system as illustrated in FIG. 13, from which it is seen that SiC, C, Si and $SiO_2$ are present in a mixture. Therefore, the rotor electrode 12 can initiate electric discharge at a very low discharge voltage and yet decrease the discharge current owing to the interactions of the $SiO_2$ which is a low dielectric-loss dielectric material necessary for the generation or the staying of electric charge required for the discharge initiation, SiC which is a high dielectric-loss dielectric material having a superior excessive discharge erasing function, C which quickly conveys electric charge and Si which slowly conveys electric charge. The high-resistance layer may include other substances or oxides of Si, C or other elements as long as SiC is included as a main component.

The method for forming the high-resistance layer 20 of the present invention may include a vacuum vapor-deposition method such as electron beam vapor-deposition method and resistance heating method, physical gas-phase film coating method such as spattering method, chemical-reaction gas-phase film forming method such as CVD method, liquid-phase film forming method applying liquid material in a solvent, and flame spraying method. The high-resistance layer 20 is attached to the electrode head without using an organic bonding material, the high-resistance layer 20 is not easily separated from the electrode head even when exposed to the high temperature electric arc and $O_3$ gas and $NO_x$ gas generated by the arc so that the operating life and the reliability of the rotor electrode is good. In particular, since the high-resistance layer 20 formed by either of the above-named methods except for the flame spraying method is dense and the discharge across the discharge gap takes place at about the interface or boundary between the dense high-resistance layer 20 and the electrode head 16, the discharge location or the leg of the arc does not move around up and down so that the discharge initiates at a substantially constant discharge voltage. The high-resistance layer 20 may include particles as illustrated in FIG. 12 as long as the layer is dense.

During the formation of the high-resistance layer 20 by vapor-deposition, the amount of oxide of Si contained in the high-resistance layer can be increased by adding oxygen gas or oxidizing gas or lowering the vacuum degree, or decreased by adding inert gas, non-oxidizing gas or reducing gas or intensifying vacuum. The preferable oxygen content of the oxide of Si is $0<x<2$ for SiOx.

Figure 14:
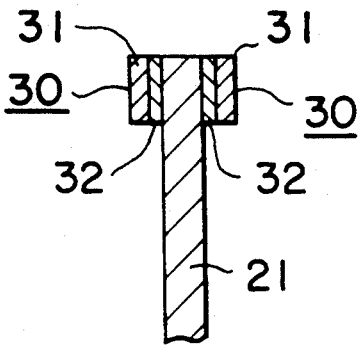
FIG. 14 is a sectional view similar to FIG. 4 but illustrating a further embodiment of the rotor electrode of the present invention.

FIGS. 14 illustrates a further embodiment, wherein a high-resistance layer 30 comprise a first layer 31 of the first ceramic material and a second layer 32 of the second ceramic material distinct from the first layer 31 from the view point of their composition and separated by a boundary defined therebetween. The first ceramic layer 31 comprises a ceramic material such as carbide ceramic or nitride ceramic exhibiting a good noise suppressing characteristic at the outer surface of the electrode head 16, and the second ceramic layer 32 comprises a ceramic material such as oxide ceramic exhibiting a good adhesive characteristic relative to the electrode head 16.

The second ceramic layer 32 is formed on a rotor electrode head 16 made of stainless steel by a vacuum vapor-deposition method such as electron beam vapor-deposition method and spattering. The ceramic material having a good adhesion to the electrode head 16 may be aluminum oxide, silicon oxide or zirconium oxide, and aluminum oxide is preferable. Formed on the second ceramic layer 32 is the first ceramic layer 31 made of carbide ceramic, preferably silicon carbide, or nitride ceramic. It is suitable that the thickness of the second ceramic layer 32 is from 1 μm to 5 μm and the thickness of the first ceramic layer 31 is from 3 μm to 7 μm and that the total thickness of the first and the second layers 31 and 32 is 5 μm to 10 μm. If desired, the formation of the first and the second ceramic layers 31 and 32 may be repeated to obtain laminated layers.

As an example, on the rotor electrode 21 of stainless steel, the second ceramic layer 32 of aluminum oxide of 3 μm thick was formed by the electron beam vapor-deposition method and the first ceramic layer 31 of silicon carbide of 5 μm thick was formed on the second ceramic layer 32. The distributor discharge voltage which affects the noise generation of thus-manufactured rotor electrode was about 50% of the rotor electrode without any ceramic high-resistance layer.

Figure 15:
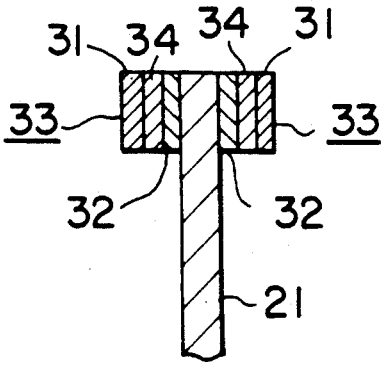
FIG. 15 is a sectional view similar to FIG. 14 illustrating another embodiment of the rotor electrode of the present invention.

FIG. 15 illustrates another high-resistance layer 33 which comprises an intermediate layer 34 having a thickness of from 3 μm to 6 μm additionally disposed between the first and second ceramic layers 31 and 32 of the embodiment illustrated in FIG. 14. The intermediate layer 34 may comprise a third ceramic material such as silicon oxide which exhibits a good adhesive characteristic to both of the first and second layers 31 and 32. A preferable material for the intermediate layer 34 is silicon oxide because it can be easily vapor-deposited, quickly formed and provide no harm to the noise-generating electromagnetic wave suppressing effect.

As an example, on the rotor electrode 21 of stainless steel, the second ceramic layer 32 of aluminum oxide of 1 μm thick was formed by the electron beam vapor-deposition method, the intermediate ceramic layer 34 of silicon oxide of 5 μm thick was formed on the second ceramic layer 32, and the first ceramic layer 31 of silicon carbide of 2 μm thick was formed on the intermediate ceramic layer 34. The distributor discharge voltage which affects the noise generation of thus-manufactured rotor electrode was about 50% of the rotor electrode without any ceramic high-resistance layer. In addition, the total time needed for the vapor-evaporation was reduced by about 20% as compared to that of the embodiment illustrated in FIG. 14.

Figure 16:
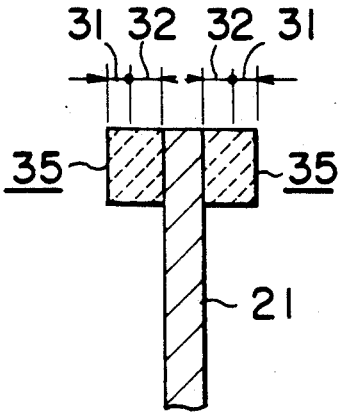
FIG. 16 is a sectional view similar to FIG. 14 but illustrating another embodiment of the rotor electrode of the present invention.

In the embodiment illustrated in FIG. 16, a high-resistance layer 35 comprises the first and second ceramic layers 31 and 32 which have different composition ratios. The first ceramic layer 31 is made of silicon carbide, and the second ceramic material 32 is made of a mixture of silicon carbide and silicon oxide, with concentration of the silicon oxide decreased in the thickness direction from the inner surface of the high-resistance layer 35 toward its outer surface.

Such high-resistance layer 35 can be formed by gradually supplying a oxidizing gas such as oxygen gas or ozone into the vacuum vapor-deposition vessel during vapor-deposition. Due to the added oxidizing gas, a portion of the evaporated silicon carbide becomes silicon oxide and a ceramic material having a strong adhesion to the rotor electrode 21 and suitable for use as the second ceramic layer 32 is formed. After the second ceramic layer 32 of a certain thickness is formed, the flow of the oxidizing gas is stopped or a reduction gas such as hydrogen gas or carbon mono-oxide gas is supplied to the vacuum vessel, thereby preventing the oxidation of the silicon carbide to form the first ceramic layer 31 made of silicon carbide. It is suitable that thickness of the second ceramic layer 32 is from 1 μm to 5 μm and the thickness of the first ceramic layer 31 is from 3 μm to 7 μm and that the total thickness is from 5 μm to 10 μm.

As an example, on the rotor electrode 21 of stainless steel, the second ceramic layer 32 of 3 μm thick was formed by the electron beam vapor-deposition method with silicon carbide used as the ceramic material while supplying oxygen gas into the vacuum deposition chamber. Then, the first ceramic layer 31 of 5 μm thick was successively formed on the second ceramic layer 32 while supplying hydrogen instead of oxygen into the deposition chamber. The distributor discharge voltage of the rotor electrode 21 which affects the noise generation was decreased by about 40% as compared to the rotor electrode without any ceramic high-resistance layer. In addition, the vapor-evaporation process can be made simpler because a single ceramic material for evaporation can be used.

As has been described, the distributor rotor electrode of the present invention comprises an electrically high-resistance layer attached to at least the pair of substantially flat surfaces and comprises a material including a ceramic effective to suppress noise electromagnetic wave radiation at the discharge surface. The high-resistance layer may have a first ceramic material exhibiting a good noise suppressing characteristic at the discharge surface and a second ceramic material exhibiting a good adhesive characteristic at where it is attached to electrode head. Therefore, the distributor rotor electrode has a superior noise suppressing effect which is reliable and stable. Also, the high-resistance layer is attached at a sufficient bonding strength.

What is claimed is:

1. A distributor rotor electrode for use in a distributor having a rotary shaft and a plurality of stationary electrodes disposed around said rotary shaft, comprising:

an electrode arm connectable at one end to the rotary shaft of the distributor for rotation therewith;

an electrode head connected to the other end of said electrode arm, said electrode head having a pair of substantially flat surfaces substantially parallel to a plane of rotation of said electrode arm and a substantially arcuated, convexed discharge surface substantially perpendicular to said plane of rotation of said electrode arm, said discharge surface facing toward the stationary electrodes of the distributor during the rotation of the rotor electrode to define successive discharge gaps therebetween; and an electrically high-resistance layer attached to at least said pair of substantially flat surfaces of said electrode head, said high-resistance layer comprising a material including a ceramic effective to suppress noise electromagnetic wave radiation at said discharge surface.

2. A distributor rotor electrode as claimed in claim 1, wherein said high-resistance layer material including SiC as a main composition.

3. A distributor rotor electrode as claimed in claim 1, wherein said high-resistance layer material comprises 10% to 70% of SiC and a mixture of SiOx, Si and C.

4. A distributor rotor electrode as claimed in claim 1, wherein said high-resistance layer material comprises SiC:C:Si:SiOx = 1: a:b:c ($0<x<2$, $0<a<4$, $0<b<4$ and $0<c<10$).

5. A distributor rotor electrode as claimed in claim 1, wherein said high-resistance layer is attached to said discharge surface as well as said pair of substantially flat surfaces.

6. A distributor rotor electrode as claimed in claim 5, wherein said high-resistance layer material comprises 10% to 70% of SiC and a mixture of SiOx, Si and C.

7. A distributor rotor electrode as claimed in claim 1, wherein said high-resistance layer is attached to each of said pair of substantially flat surfaces, and said arcuated discharge surface of said electrode head is exposed to said discharge gaps.

8. A distributor rotor electrode as claimed in claim 7, wherein said high-resistance layer material comprises 10% to 70% of SiC and a mixture of SiOx, Si and C.

9. A distributor rotor electrode as claimed in claim 1, wherein said substantially arcuated discharge surface has a plurality of ridges and grooves extending substantially perpendicularly to said plane of rotation.

10. A distributor rotor electrode as claimed in claim 9, wherein said ridges and grooves define a substantially wave-shaped contour.

11. A distributor rotor electrode as claimed in claim 9, wherein said ridges and grooves define a substantially comb-shaped contour.

12. A distributor rotor electrode as claimed in claim 9, wherein said ridges and grooves are provided only in the central portion of said arcuated discharge surface.

13. A distributor rotor electrode as claimed in claim 7, wherein said exposed arcuated discharge surface of said electrode head has a width dimension in the direction perpendicular to said plane of rotation of 3 mm or less.

14. A distributor rotor electrode as claimed in claim 1, wherein said substantially flat surfaces parallel to said plane of rotation are tapered relative to each other to provide a smaller thickness of the electrode head at the arcuated discharge surface.

15. A distributor rotor electrode as claimed in claim 1, wherein said electrode head comprise a reduced-thickness portion providing a smaller thickness of the electrode head at the arcuated discharge surface.

16. A distributor rotor electrode as claimed in claim 1, wherein said high-resistance layer comprises a first ceramic layer of a first ceramic material exhibiting a good noise suppressing characteristic at an outer surface of said high-resistance layer and a second ceramic layer of a second ceramic material exhibiting a good adhesive characteristic at a surface at which said high-resistance layer is attached to said flat surfaces of said electrode head.

17. A distributor rotor electrode as claimed in claim 16, wherein said first ceramic material comprises carbide ceramic and said second ceramic material comprises oxide ceramic.

18. A distributor rotor electrode as claimed in claim 16, wherein said carbide ceramic comprises silicon carbide and said oxide ceramic comprises aluminum oxide.

19. A distributor rotor electrode as claimed in claim 16, wherein said first ceramic material comprises nitride ceramic and said second ceramic material comprises oxide ceramic.

20. A distributor rotor electrode as claimed in claim 16, wherein said first ceramic material comprises carbide ceramic and said second ceramic material comprises carbide ceramic and oxide ceramic.

21. A distributor rotor electrode as claimed in claim 16, wherein said first ceramic material comprises silicon carbide, and said second ceramic material comprises silicon carbide and silicon oxide.

22. A distributor rotor electrode as claimed in claim 16, said high-resistance layer further comprises an intermediate layer disposed between said first and second ceramic layers, said intermediate layer comprising a third ceramic material exhibiting a good adhesive characteristic to both of said first and second ceramic layers.

23. A distributor rotor electrode as claimed in claim 22, wherein said third ceramic material comprises silicon oxide.

* * * * *